US006149277A

United States Patent [19]

Broussard

[11] Patent Number: 6,149,277

[45] Date of Patent: Nov. 21, 2000

[54] SHOWER MIRROR

[76] Inventor: Kim Broussard, 3130 Grand Concourse #7T, Bronx, N.Y. 10458

[21] Appl. No.: 09/378,579

[22] Filed: Aug. 20, 1999

[51] Int. Cl.[7] ..... G03B 11/04; A47K 3/22

[52] U.S. Cl. ..... 359/512; 359/507; 4/605

[58] Field of Search ..... 359/507, 512, 359/514; 4/605; 248/55, 74.1, 74.2

[56] References Cited

U.S. PATENT DOCUMENTS 3,813,072 5/1974 Moore ..... 248/313

5,604,633 2/1997 Christianson ..... 359/507

*Primary Examiner*—Cassandra Spyrou

*Assistant Examiner*—Jared Treas

*Attorney, Agent, or Firm*—Goldstein & Canino

[57] ABSTRACT

A shower mirror, for attaching onto a shower head pipe, comprising a generally rectangular housing and an attachment device for attaching onto the pipe. The housing has a housing front having an inner frame, which encloses a fog-free, wide view mirror element. The attachment device includes a tubular clip having an opening for selectively mounting onto the shower head pipe, and a pair of ropes which extend from the clip to the housing to support the housing immediately below the shower head pipe. Lights are present on the housing front, which are operable with a push-button. A clock is also present on the housing front to provide the current time of day.

6 Claims, 3 Drawing Sheets

SHOWER MIRROR

BACKGROUND OF THE INVENTION

The invention relates to a shower mirror. More particularly, the invention relates to a mirror which is hung beneath a shower head, which provides an illuminated, fog-free image as well as the time of day.

Showering is activity undertaken by people one or more times a day. In addition to washing, both women and men often choose to perform other grooming tasks while in the shower.

Many men prefer to shave their faces while their beard is softened by the steam and hot water in the shower, and while shaving cream and shavings can be conveniently washed away. However, typically a mirror is required to properly guide the razor used to shave the face while minimizing the chance of cutting.

Women often like to apply skin treatments immediately after a hot shower while their skin is still moist and soft. Such grooming cannot be done in front of a conventional mirror, because in a steamy bathroom, a thick layer of condensation will form on the mirror and completely obscure it.

Both men and women often would like to be able to see themselves as they shampoo their hair. In particular, it would be helpful to be able to see if they have fully rinsed shampoo, conditioner, and other hair care products fully from their hair before leaving the shower.

Others have attempted to provide mirrors for use in the bathroom. U.S. Pat. No. 5,604,633 to Christianson discloses a condensation-free shower mirror which is heated by the hot stream from the shower. Unfortunately, Christianson is designed to interrupt the path of the shower. As such, it will likely cause flooding in the bathroom when high pressure water from the shower head is deflected sideways off the mirror.

U.S. Pat. No. 4,701,594 to Powell discloses a combination mirror defogging and drying device. Since Powell must use line level electricity to operate, it is unsuitable for use in the shower.

U.S. Pat. No. 4,733,468 to Zadro discloses a shaving system in which water from the shower is used to generate electricity and to defog the mirror. However, in order to operate, Zadro requires that the device be connected to the shower plumbing. Such connection is beyond the scope of a typical consumer's expertise.

While these units may be suitable for the particular purpose employed, or for general use, they would not be as suitable for the purposes of the present invention as disclosed hereafter.

SUMMARY OF THE INVENTION

It is an object of the invention to produce a mirror which is designed for use in the shower.

It is another object of the invention to provide a mirror which is illuminated to provide a better view. Accordingly, lights are provide at top, bottom, left, and right positions, which are selectively illuminable at the user's option.

It is a further object of the invention to provide a mirror which is easily mountable in the shower. Accordingly, the shower mirror is mounted with a clip which secures between the shower head and wall, wherein a pair of ropes drape from the clip so that the mirror is suspended immediately therebelow.

It is a still further object of the invention to provide a mirror which provides a user with the current time. Accordingly, a clock is provided integral with the mirror assembly.

The invention is a shower mirror, for attaching onto a shower head pipe, comprising a generally rectangular housing and an attachment device for attaching onto the pipe. The housing has a housing front having an inner frame, which encloses a fog-free, wide view mirror element. The attachment device includes a tubular clip having an opening for selectively mounting onto the shower head pipe, and a pair of ropes which extend from the clip to the housing to support the housing immediately below the shower head pipe. Lights are present on the housing front, which are operable with a push-button. A clock is also present on the housing front to provide the current time of day.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
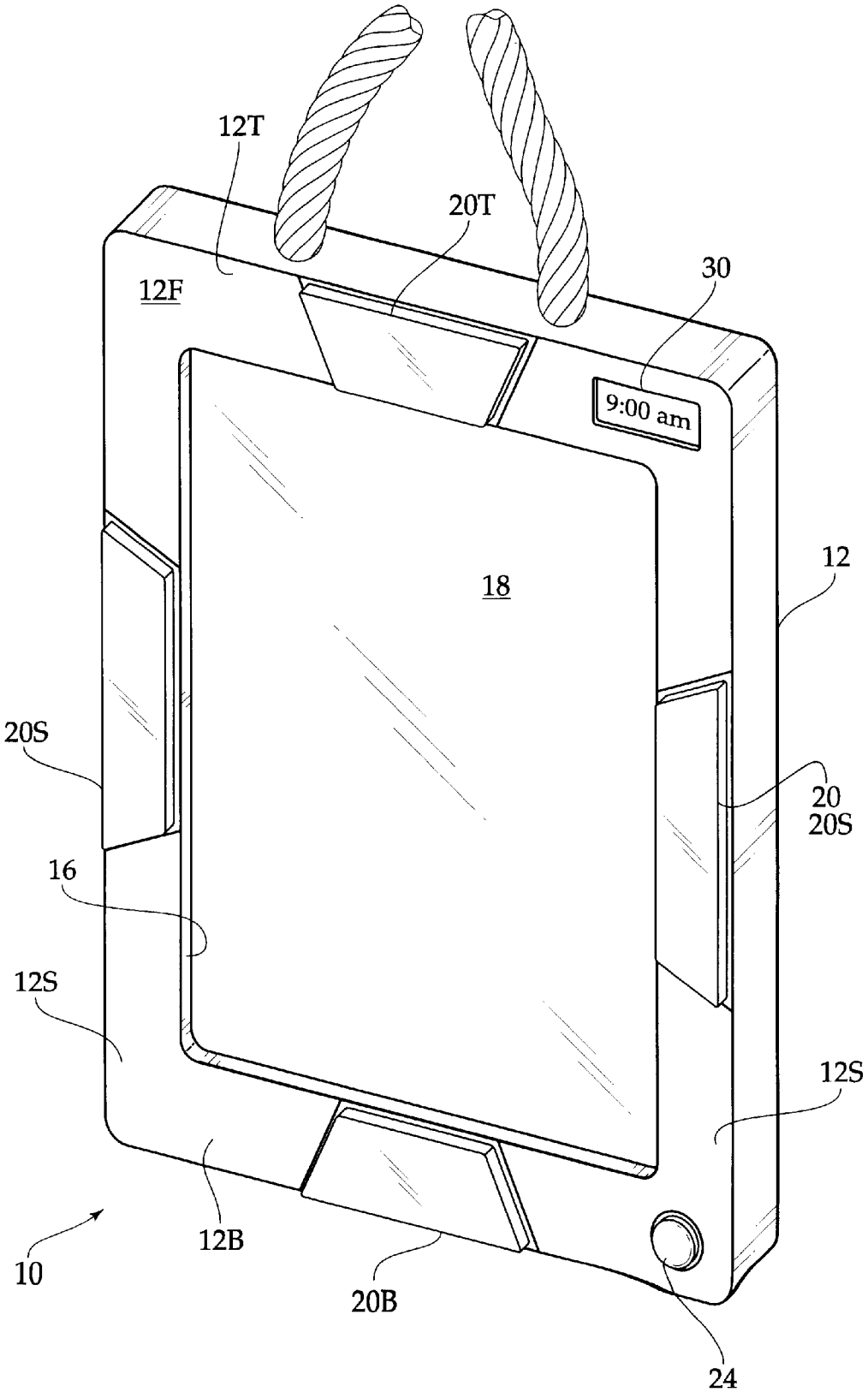
FIG. 1 is a diagrammatic perspective view, illustrating a shower mirror according to the present invention.

FIG. 1 illustrates a shower mirror 10, comprising a generally rectangular housing 12 having a housing front 12T, the housing front 12T including a housing top 12T, a pair of housing sides 12S, and a housing bottom 12B. The housing is preferably made of a lightweight and durable plastic. The rectangular housing 12 has a generally rectangular inner frame 16 on the housing front 12T, which frames a mirror element 18. According to the present invention, the mirror element 18 is a wide view, fog-free mirror. The specific materials of which the mirror element can be made in order to be fog-free, or fog resistant is well known to those of ordinary skill in the art, and is therefore beyond the scope of the discussion herein.

The mirror 10 has a plurality of lights 20 on the housing front 12T. More particularly, a top light 20T is centered on the housing top 12T; a bottom light 20B is centered on the housing bottom 12B; and two side lights 20S are centered on the housing sides 12S. A push-button 24 is located on the housing bottom 12B for controlling the lights 20. In particular, on a first press of the push-button 24, the top light 20T and bottom light 20B are illuminated. On a second press of the push-button 24, the side lights 20S are illuminated, as well as the top light 20T and bottom light 20B. On a third press of the push-button 24, all lights 20 are extinguished. Control of the lights 20 using the push-button 24 according to the foregoing functional description may be provided using conventional components and conventional wiring as would be appreciated by one of ordinary skill in the art. In addition, internal power supplies, such as rechargeable or disposable batteries may be provided, which is similarly beyond the scope of the discussion herein.

A clock 30 is provided on the housing front 12F. The clock 30 provides the current time of day in a conventional twelve hour format, also indicating "AM" or "PM" when appropriate. The clock 30 is also preferably backlit for illumination.

Figure 2:
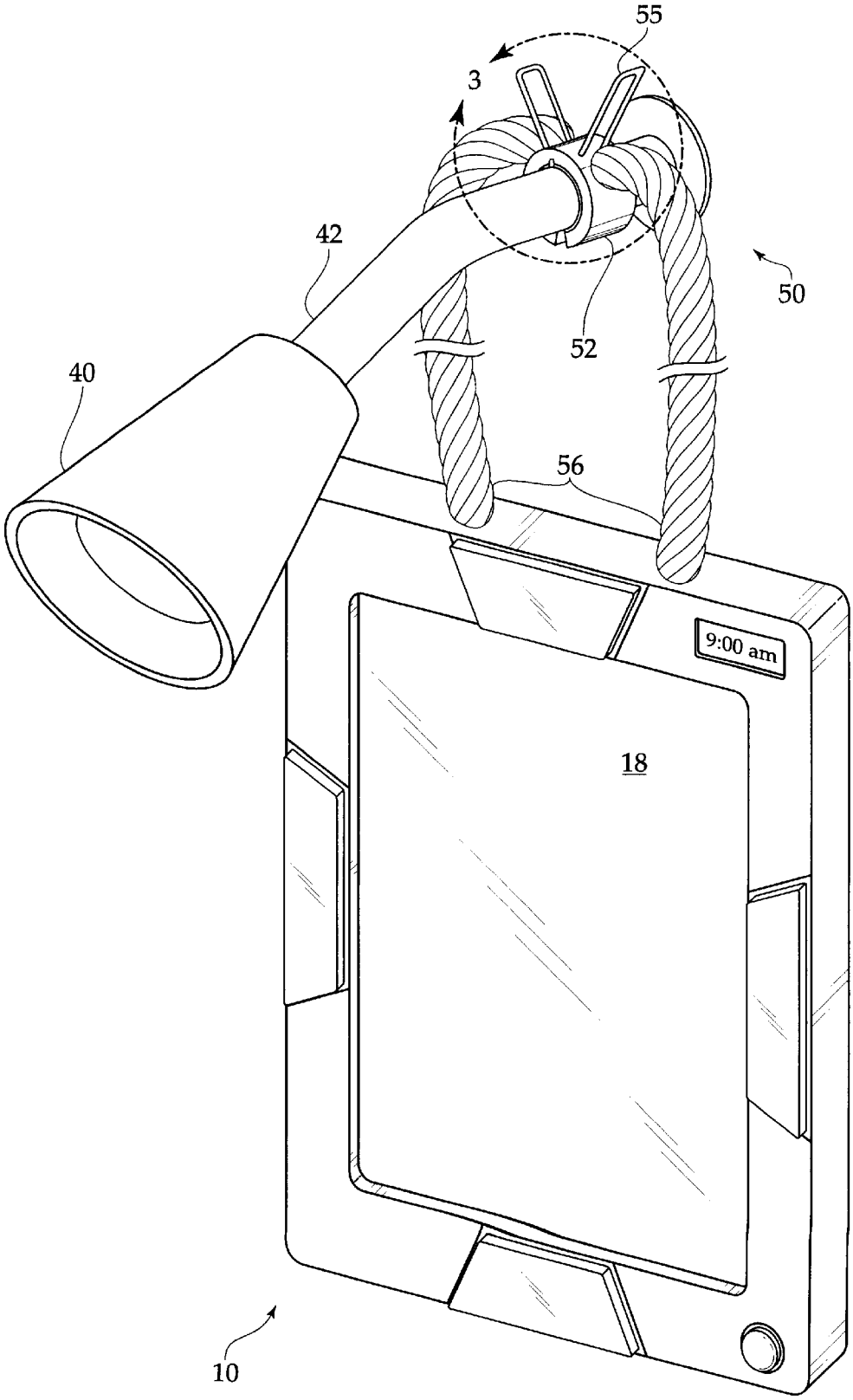
FIG. 2 is a diagrammatic perspective view, illustrating the shower mirror in use, hung beneath a shower head.
Figure 3:
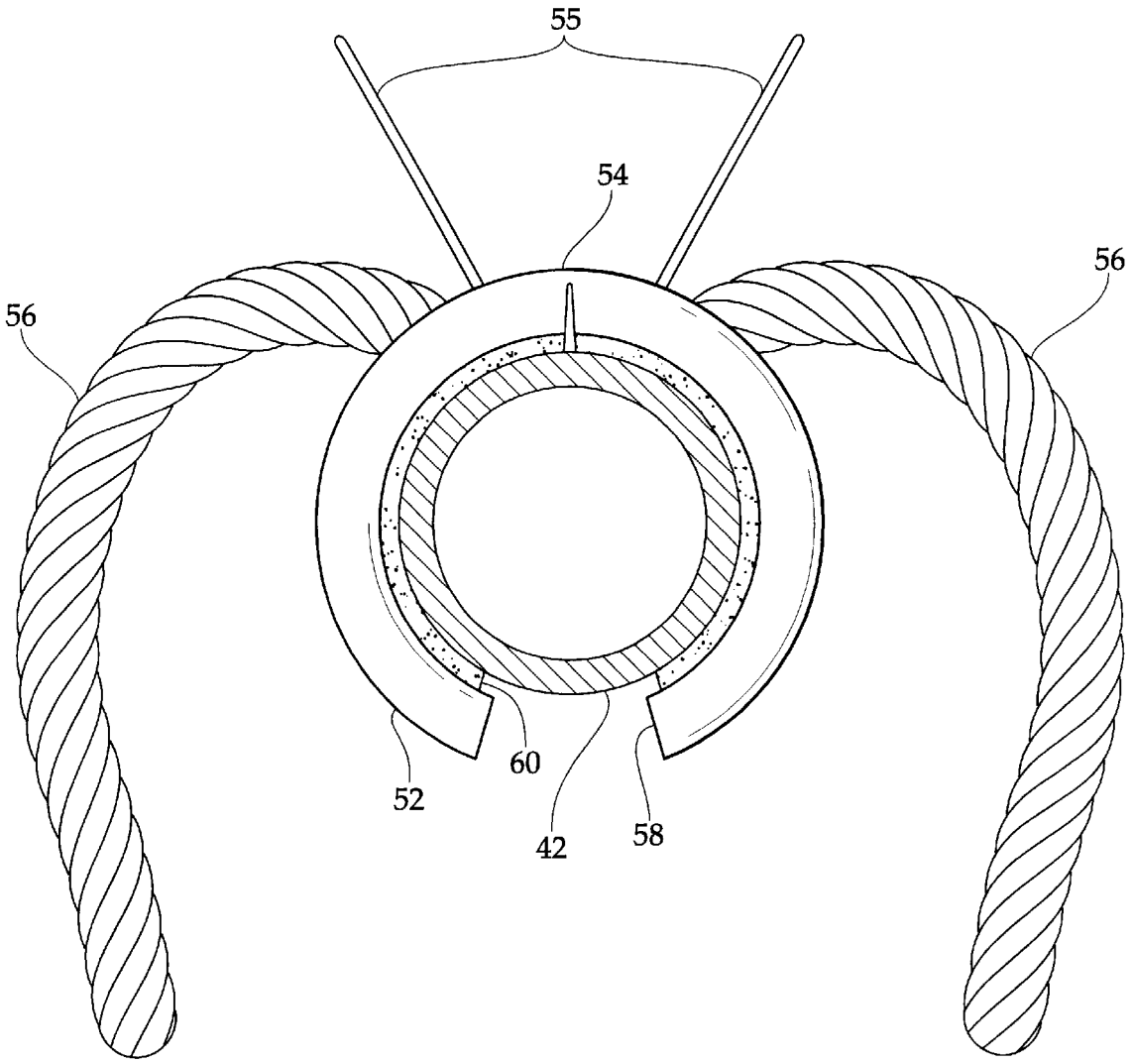
FIG. 3 is an enlarged front elevational view, taken generally in the area circle 3 in FIG. 2, showing the attachment mechanism.

FIG. 2 illustrates the shower mirror 10 in use, hung beneath a shower head 40. The shower head 40 is conventionally connected to indoor plumbing within a wall (not shown), using a shower head pipe 42. The shower mirror has an attachment device 50 which attaches the shower mirror 10 onto the shower head pipe 42. More particularly, the attachment device comprises a tubular clip 52 having a clip top 54, and a pair of ropes 56 extending upward and outward from the clip top 54, and draping downward therefrom, as seen in FIG. 3. Also seen best in FIG. 3, the clip 52 has a longitudinal opening 58 which is opposite the clip top 54. The clip 52 also has a pair of handles 55 adjacent to the clip top 54. The handles 55 extend radially from the clip 52, and together form an acute angle. Thus, in use, the handles are grasped between the thumb and forefinger, and are pressed inward to help spread the opening 58. The longitudinal opening 58 is pressed downward onto the shower head pipe 42 until the opening 58 spreads to allow the pipe 42 into the clip. The longitudinal opening 58 then retracts and encircles the pipe 42. Rubber padding 60 covers internal surfaces of the clip 52 to prevent damage to the pipe 42. The clip 52 itself is preferably made of a deformable plastic.

Referring back to FIG. 2, the ropes 56 are attached to the housing 12 near the housing top 12T for supporting the weight of the housing 12 and all associated components. The ropes 56 are shown to be of arbitrary length. The particular length chosen for the ropes is determined so that the mirror element 18 is substantially at eye level when the shower mirror 10 is attached onto the shower head pipe 42.

In conclusion, herein is presented a shower mirror which attaches onto a shower head pipe adjacent to a shower head, and provides a user with a fog free, selectively illuminable mirror.

What is claimed is:

1. A shower mirror, for mounting onto a shower head pipe, comprising:

a housing, containing a fog free mirror element;

an attachment device, having a tubular clip having a longitudinal opening and a clip top opposite the longitudinal opening, a pair of handles extend radially from the clip near the clip top for spreading the longitudinal opening, the attachment device further having a pair of ropes which extend upward and outward from the clip top and then drape downward over the clip to support the housing.

2. The shower mirror as recited in claim 1, wherein the housing is generally rectangular having a housing front which has a housing top, a housing bottom, and a pair of housing sides, the housing front having a generally rectangular housing inner frame which defines and encases the mirror element.

3. The shower mirror as recited in claim 2, further comprising a plurality of lights, and a push-button on the housing front, for selectively illuminating the lights.

4. The shower mirror as recited in claim 3, wherein the lights comprise a top light which is centered on the housing top, a bottom light which is centered on the housing bottom, and a pair of side lights which are centered on the housing sides.

5. The shower mirror as recited in claim 4, wherein when the push-button is pressed once the top light and bottom light are illuminated; wherein when the push-button is pressed twice the top light, bottom light, and side lights are illuminated; and wherein when the push-button is pressed three times all lights are extinguished.

6. The shower mirror as recited in claim 5, further comprising a clock located in the front panel.

* * * * *